US006554414B2

(12) United States Patent
Ylitalo et al.

(10) Patent No.: US 6,554,414 B2
(45) Date of Patent: Apr. 29, 2003

(54) ROTATABLE DRUM INKJET PRINTING APPARATUS FOR RADIATION CURABLE INK

(75) Inventors: Caroline M. Ylitalo, Stillwater, MN (US); Bruce A. Nerad, Oakdale, MN (US); Richard L. Severance, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/001,101

(22) Filed: Nov. 15, 2001

(65) Prior Publication Data

US 2002/0175984 A1 Nov. 28, 2002

Related U.S. Application Data

(60) Provisional application No. 60/259,577, filed on Jan. 2, 2001.

(51) Int. Cl.[7] ..... B41J 2/01

(52) U.S. Cl. ..... 347/102

(58) Field of Search ..... 346/25; 347/102, 347/101, 104, 105, 106, 107, 43, 4; 399/300; 219/216; 101/488; 34/304, 381; 516/70; 8/471

(56) References Cited

U.S. PATENT DOCUMENTS

| | | | |
|---|---|---|---|
| 4,469,026 | A | 9/1984 | Irwin |
| 4,774,523 | A | 9/1988 | Beaufort et al. |
| 5,275,646 | A | 1/1994 | Marshall et al. |
| 5,349,905 | A | 9/1994 | Taylor et al. |
| 5,502,464 | A | 3/1996 | Takahashi et al. |
| 5,508,826 | A | 4/1996 | Lloyd et al. |
| 5,511,477 | A | 4/1996 | Adler et al. |

(List continued on next page.)

FOREIGN PATENT DOCUMENTS

| | | |
|---|---|---|
| EP | 0 134 591 | 3/1985 |
| EP | 0 658 607 | 9/1998 |
| EP | 0 875 382 | 11/1998 |
| EP | 0 889 639 | 1/1999 |
| EP | 0 978 390 | 2/2000 |
| EP | 1 034 936 | 9/2000 |
| EP | 1 046 511 | 10/2000 |
| EP | 1 108 553 | 6/2001 |
| GB | 2 142 579 | 1/1985 |

(List continued on next page.)

OTHER PUBLICATIONS

Practical Considerations for Using UV Reactive Inks in Piezo DOD Printheads, Richar J. Baker, Spectra Inc., Hanover, New Hampshire, USA, 1999, pp. 111–115.

Noguchi, Hiromichi, Final Program and Proceedings of IS&T's NIP14: International Conference on Digital Printing Technologies, IS&T—The Society for Imaging Science and Technology, Oct. 1998, UV Curable, Aqueous Ink Jet Ink: Material Design and Performance for Digital Printing, pp. 107–110.

56281US003, U.S. Ser. No. 10/000,282, filed Nov. 15, 2001.

56282US003, U.S. Ser. No. 10/001,144, filed Nov. 15, 2001.

55435US002, U.S. Ser. No. 09/562,018, filed May 1, 2000.

*Primary Examiner*—Raquel Yvette Gordon
(74) *Attorney, Agent, or Firm*—James D. Christoff

(57) ABSTRACT

Inkjet printing apparatus includes a drum, a print head for directing radiation curable ink toward a substrate on the drum, and a curing device for directing radiation toward the ink that is received on the substrate. The curing device is selectively operable to direct radiation toward a certain portion of the ink received on the substrate only after that certain portion has moved with the substrate and the drum through an arc that is at least 360 degrees. In this manner, the ink on the substrate has sufficient time to spread and level and the resultant image is of high quality.

29 Claims, 2 Drawing Sheets

U.S. PATENT DOCUMENTS

| | | | |
|---|---|---|---|
| 5,530,466 | A | 6/1996 | Fujioka et al. |
| 5,721,086 | A | 2/1998 | Emslander et al. |
| 5,757,407 | A | 5/1998 | Rezanka |
| 5,771,054 | A | 6/1998 | Dudek et al. |
| 5,847,743 | A | 12/1998 | Look |
| 5,875,287 | A | 2/1999 | Li et al. |
| 5,981,113 | A | 11/1999 | Christian |
| 6,039,426 | A | 3/2000 | Dobbs |
| 6,082,911 | A | 7/2000 | Murakami |
| 6,092,890 | A | 7/2000 | Wen et al. |
| 6,114,022 | A | 9/2000 | Warner et al. |
| 6,145,979 | A | 11/2000 | Caiger et al. |
| 6,248,404 | B1 | 6/2001 | Greene-Mathis |

FOREIGN PATENT DOCUMENTS

| | | |
|---|---|---|
| GB | 2 233 928 | 1/1991 |
| GB | 2 322 597 | 9/1998 |
| GB | 2 338 212 | 12/1999 |
| JP | 62109645 | 5/1987 |
| JP | HEI 1-133746 | 5/1989 |
| JP | 02092642 | 3/1990 |
| JP | 6-200204 | 7/1994 |
| JP | 8218016 | 8/1996 |
| JP | 8218017 | 8/1996 |
| JP | 8218018 | 8/1996 |
| JP | 10-207978 | 8/1998 |
| JP | 11-070645 | 3/1999 |
| JP | 200211219 | 8/2000 |
| WO | WO 97/04964 | 2/1997 |
| WO | WO 97/27053 | 7/1997 |
| WO | WO 97/31071 | 8/1997 |
| WO | WO 99/08875 | 2/1999 |
| WO | WO 99/29788 | 6/1999 |
| WO | WO 00/73083 | 12/2000 |
| WO | WO 01/17780 | 3/2001 |

ROTATABLE DRUM INKJET PRINTING APPARATUS FOR RADIATION CURABLE INK

This application claims benefit of S. No. 60/259,577 filed Jan. 2, 2001.

BACKGROUND OF THE INVENTION

1. Field of the Invention

This invention relates to inkjet printing apparatus for radiation curable ink. The apparatus includes a rotating drum for supporting a substrate during printing.

2. Description of the Related Art

Inkjet printing has increased in popularity in recent years due to its relatively high speed and excellent image resolution. Moreover, inkjet printing apparatus used in conjunction with a computer provides great flexibility in design and layout of the final image. The increased popularity of inkjet printing and the efficiencies in use have made inkjet printing an affordable alternative to previously known methods of printing.

Inks commonly used in inkjet printers include water-based inks and solvent-based inks. Water-based inks are used with porous substrates or substrates that have a special receptor coating to absorb the water. In general, water-based inks are not satisfactory when used for printing on non-coated, non-porous films.

Solvent-based inks used in inkjet printers are suitable for printing on non-porous films and overcome the problem noted above relating to water-based ink. Unfortunately, many solvent-based inks contain about 90 percent organic solvents by weight. As solvent-based inks dry, the solvent evaporates and may present an environmental hazard. Although environmental systems may be available for reducing the emission of solvents to the atmosphere, such systems are generally considered expensive, especially for the owner of a small print shop.

Furthermore, inkjet printers using either solvent-based inks or water-based inks must dry relatively large quantities of solvent or water before the process is considered complete and the resulting printed product can be conveniently handled. The step of drying the solvents or water by evaporation is relatively time-consuming and can be a rate limiting step for the entire printing process.

In view of the problems noted above, radiation-curable inks have become widely considered in recent years as the ink of choice for printing on a wide variety of non-coated, non-porous substrates. The use of radiation curing enables the ink to quickly dry in "instant" fashion without the need to drive off large quantities of water or solvent. As a result, radiation curable inks can be used in high speed inkjet printers that can achieve production speeds of over 1000 $ft^2$/hr (93 $m^2$/hr.)

However, there is a need in the art to improve certain aspects of inkjet printing using radiation-curable ink. In particular, there is a continuing demand to increase the speed of inkjet printing without adversely affecting the quality of the printed image. Such improvements, if attained, could result in a considerable time savings for the operator as well as reduce the need in some circumstances to purchase additional printers to keep up with business demands.

SUMMARY OF THE INVENTION

The present invention is directed toward an inkjet printer having a curing device that is adapted to direct radiation such as ultraviolet ("UV") radiation toward ink on the substrate in a manner that helps to optimize the resolution of the final printed image. The inkjet printer of this invention includes a rotating drum for supporting the substrate during printing. The curing device enables the operator to direct radiation, at the operator's option, to the ink on the substrate only after the ink has moved with the substrate and the drum through an arc that is at least 360 degrees. In this manner, the ink has sufficient time to spread and level on the substrate such that the resulting image is of high quality.

In more detail, the present invention is directed in one aspect to inkjet printing apparatus that comprises a drum for supporting a substrate. The drum has a central reference axis. The apparatus also includes a motor for moving the drum with the substrate in an arc about the central axis. The apparatus further includes a print head for directing radiation curable ink toward the substrate, and a curing device for directing radiation toward the ink received on the substrate. The curing device is selectively operable to direct radiation toward a certain portion of the ink received on the substrate only after that certain portion has moved with the substrate along an arc about the central axis that is at least 360 degrees.

The present invention is directed in another aspect toward a method of inkjet printing. The method includes the acts of supporting a substrate on a drum and moving the drum in an arc about its central axis. The method also includes the acts of directing radiation curable ink onto the substrate, and determining a desired time interval between the time that the ink is received on the substrate and the time that the ink is cured. The method further includes the act of directing radiation toward the ink on the substrate. The act of directing the radiation toward the substrate includes the act of selectively adjusting the time interval between the time that the ink is received on the substrate and the time that the radiation is received by the ink on the substrate such that at least a portion of the ink does not receive radiation until the substrate with the ink portion has moved with the drum along an arc that is at least 360 degrees.

These and other aspects of the invention are described in more detail below and are illustrated in the accompanying drawings.

DETAILED DESCRIPTION OF THE PREFERRED EMBODIMENTS

The following examples describe various types of inkjet printing apparatus and printing methods for a rotating drum type inkjet printer according to the invention. The accompanying drawings are schematic illustrations selected to highlight certain aspects of the invention. In practice, the concepts described below may be adapted for use with commercially available rotating drum inkjet printers such as "PressJet" brand printers from Scitex (Rishon Le Zion, Israel) and "Dryjet" Advanced Digital Color Proofing System from Dantex Graphics Ltd. (West Yorkshire, UK).

Figure 1:
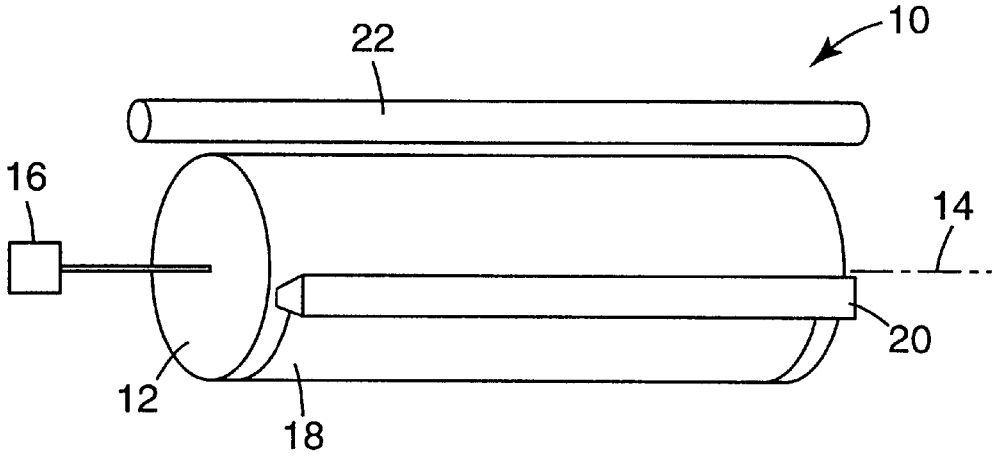
FIG. 1 is a schematic, perspective view showing a portion of an inkjet printing apparatus according to one embodiment of the present invention.
Figure 2:
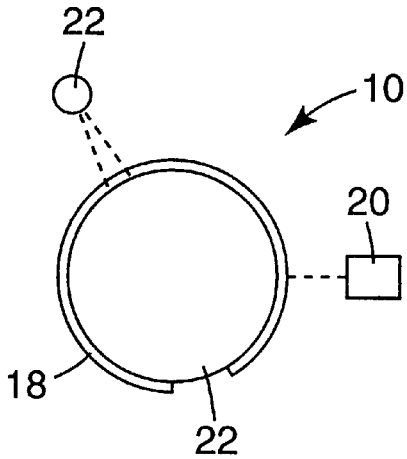
FIG. 2 is a schematic end elevational view of the apparatus shown in FIG. 1.

FIGS. 1 and 2 show an inkjet printing apparatus 10 according to one embodiment of the present invention. The apparatus 10 includes a cylindrical drum 12 for supporting a substrate to be printed. The drum 12 includes a central reference axis that is designated by the numeral 14 in FIG. 1.

The apparatus 10 also includes a motor 16 for rotatably moving the drum 12 about its central axis 14. The motor 16 may be connected to the drum 12 by any suitable means, including a chain drive system, a belt drive system, a gear mechanism or the like. The motor 16 is connected to a controller (not shown) for starting or stopping rotational movement of the drum 12 when desired.

A substrate 18 to be printed is received on the external surface of the drum 12. The substrate 18 may be made of any suitable material that is compatible with the selected inks and that exhibits satisfactory characteristics once placed in use in a desired location. Examples of suitable substrates 18 include both porous and nonporous materials such as glass, wood, metal, paper, woven and non-wovens, and polymeric films. Nonlimiting examples of such films include single and multi-layer constructions of acrylic-containing films, poly (vinyl chloride)-containing films, (e.g., vinyl, plasticized vinyl, reinforced vinyl, vinyl/acrylic blends), urethane-containing films, melamine-containing films, polyvinyl butyral-containing films, and multi-layered films having an image reception layer comprising an acid- or acid/acrylate modified ethylene vinyl acetate resin, as disclosed in U.S. Pat. No. 5,721,086 (Emslander et al.) or having an image reception layer comprising a polymer comprising at least two monoethylenically unsaturated monomeric units, wherein one monomeric unit comprises a substituted alkene where each branch comprises from 0 to about 8 carbon atoms and wherein one other monomeric unit comprises a (meth)acrylic acid ester of a nontertiary alkyl alcohol in which the alkyl group contains from 1 to about 12 carbon atoms and can include heteroatoms in the alkyl chain and in which the alcohol can be linear, branched, or cyclic in nature.

Optionally, one side of the film opposite the printed side includes a field of pressure sensitive adhesive. Usually, the field of adhesive on one major surface is protected by a release liner. Moreover, the films can be clear, translucent, or opaque. The films can be colorless, a solid color or a pattern of colors. The films can be transmissive, reflective, or retroreflective. Commercially available films known to those skilled in the art include the multitude of films available from 3M Company under the trade designations PANAFLEX, NOMAD, SCOTCHCAL, SCOTCHLITE, CONTROLTAC, and CONTROLTAC-PLUS.

Optionally, the print head 14 includes an additional set of nozzles that is in communication with a source of clear ink or other material that lacks color. The clear ink can be printed on the substrate 12 before any colored ink is applied, or can be printed over the entire image. Printing clear ink over the entire image can be used to improve performance of the finished product, such as by improving durability, gloss control, resistance to graffiti and the like.

The printing apparatus 10 also includes a print head 20 for directing radiation such as UV radiation curable ink toward the substrate 18. In this embodiment, the print head 20 comprises a bank of print heads that extends substantially across the entire axial length of the drum 12. The print head 20 is connected to a source of UV radiation curable ink (not shown). In addition, the print head 20 is electrically coupled to the controller mentioned above for selective activation when desired. Examples of UV curable inkjet inks that can be used in the apparatus 10 include compositions such as those described in U.S. Pat. Nos. 5,275,646 and 5,981,113 and PCT application Nos. WO 97/31071 and WO 99/29788.

As one option, the length of the print head 20 may be substantially equivalent to the axial length of the drum 12. As another option, the length of the print head 20 may be shorter than the length of the drum 12. In the latter embodiment, the print head 20 is mounted on a carriage for movement along its longitudinal axis. The carriage is connected to a drive means (such as a stepping motor that is coupled to a rack and pinion assembly) and the drive means is connected to the controller for selective movement. Movement of the print head 20 enables the substrate 18 to be printed across its entire width as may be desired.

Optionally, the print head 20 is operable to simultaneously print ink of different colors. To this end, the print head 20 may include a first set of nozzles that are in fluid communication with a first ink source of a certain color and a second set of nozzles that are in communication to a second source of ink of a different color. Preferably, the print head 20 has at least four sets of nozzles that are in communication with at least four corresponding ink sources. As a result, the print head 20 is operable to simultaneously print at least four inks of different colors so that a wide color spectrum in the final printed image can be achieved.

The apparatus 10 also includes a curing device 22 for directing radiation toward ink that is received on the substrate 18. The curing device may include one or more sources of radiation, each of which is operable to emit light in the ultraviolet, infrared and/or the visible spectrum. Suitable sources of UV radiation include mercury lamps, xenon lamps, carbon arc lamps, tungsten filament lamps, lasers and the like. Optionally, the sources of radiation are lamps of a type commonly known as "instant-on, instant-off" so that the time that the radiation reaches the substrate 18 can be precisely controlled.

The curing device 22 is electrically connected to the controller described above for activation and deactivation of the source(s) of radiation. The controller is operable to selectively activate the curing device such that the UV radiation reaches the ink that is received on the substrate 18 only after such ink has moved with the substrate 18 through an arc about the central axis 14 that is at least 360 degrees. As a result, the ink on the substrate 18 does not receive ultraviolet radiation from the curing device 22 during its first pass beneath the same in this mode of operation, but instead receives radiation only after at least one revolution beneath the curing device 22 has occurred.

A variety of methods are available for carrying out the invention using the apparatus 10 shown in FIGS. 1 and 2. For example, the curing device 22 may be activated by the controller only after the print head 20 has deposited a first portion of ink on the substrate 18 and the substrate 18 has had an opportunity to move through an arc of at least 360 degrees. In this example, the first portion of the ink has sufficient time to spread and level before being cured or partially cured. The curing device 22 is then deactivated by the controller and the controller reactivates the print head 20 to direct a second portion of ink to the substrate 18.

As another example, the curing device 22 may comprise a number of discreet lamps that are spaced along an axis that is parallel to the reference axis 14. The radiation emitted from each lamp is masked to provide segments of radiation that are directed only toward a certain section of the substrate 18 that is located in a certain position along the length of the axis 14. Similarly, the print head 20 may comprise a number of discreet nozzles, one or more of which are located in the same axial position with respect to a certain lamp of the curing device 22. Consequently, when the controller operates the print head 20 to cause certain nozzles to direct ink toward the substrate 18, the lamps of the curing device 22 that are located in the same axial position as such nozzles of the print head 20 are not activated until such time as the drum 12 with the substrate 18 has moved along an arc that is at least 360 degrees.

As a further example, the curing device 22 may comprise a series of LED lamps arranged in a row, where various lamps are activated as needed. Alternatively, fiber optics connected to a lamp could be mounted on a movable carriage for movement across the drum 12.

Optionally, a number of nozzles of the print head 20 may be simultaneously activated to direct ink toward the substrate 18 at certain respective, spaced apart locations along the length of the axis 14. Corresponding lamps of the curing device 22 located at the same relative position along the length of the axis 14 are then actuated after the drum 12 with the substrate has passed through an arc of at least 360 degrees. In the meantime, a second set of nozzles is activated by the controller to direct ink to certain portions of the substrate 18 that are between the previously printed portions. In this manner, the printing is staggered, and curing of the ink received on certain sections of the substrate may be carried out while other sections of the substrate receive ink.

As yet another option, the drum 12 may contain an internal heater for heating the substrate 18. Drum heaters for inkjet printing apparatus are known in the art. Preferably, the heater is connected to the controller for controlling energization of the heater when desired, or for controlling energization of the heater in certain, specific locations of the drum corresponding to sections of the substrate 18 that have received ink or that soon will receive ink.

The apparatus 10 may also include a computer connected to the controller. The computer is programmed to determine preferred dwell times for the ink, or the time interval between the time that the ink is received on the substrate 18 and the time that the ink receives radiation from the curing device 22. The dwell time is then set by instructions provided by the computer. Further details of this aspect are described in applicant's co-pending U.S. patent application entitled "METHOD AND APPARATUS FOR INKJET PRINTING USING UV RADIATION CURABLE INK", Ser. No. 10/000,282 [attorney docket no. 56281US003], filed on even date herewith and expressly incorporated by reference herein.

In addition, the apparatus 10 may include automated methods for altering test pattern images that have been received on the substrate 18 for assessing certain characteristics, such as adhesion of a particular ink to a particular substrate. Certain printing parameters are then selected by a computer based on the assessment of the altered test pattern images. Further details of this aspect are described in applicant's pending U.S. patent application entitled "METHOD AND APPARATUS FOR SELECTION OF INKJET PRINTING PARAMETERS", Ser. No. 10/001,144 [attorney docket no. 56282US003], filed on even date herewith and expressly incorporated by reference herein.

Figure 3:
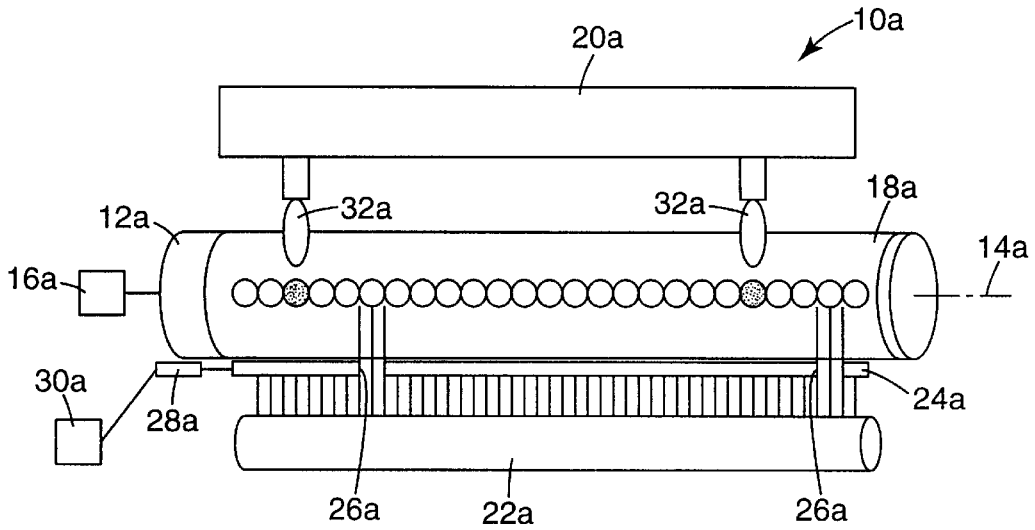
FIG. 3 is a schematic plan view of an inkjet printing apparatus according to another embodiment of the invention.
Figure 4:
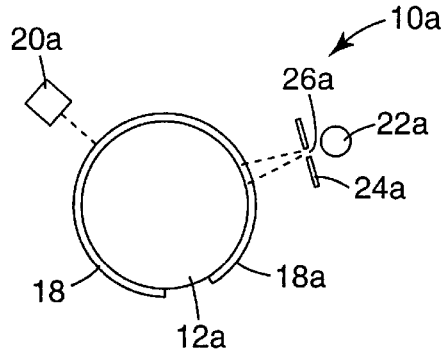
FIG. 4 is a schematic end elevational view of the inkjet printing apparatus depicted in FIG. 3.

An apparatus 10*a* according to another embodiment of the invention is illustrated in FIGS. 3 and 4. The apparatus 10*a* includes a cylindrical drum 12*a* that is similar to the drum 12. The drum 12*a* has a central axis 14*a*. A motor 16*a* is connected to the drum 12*a* for selective rotation of the latter.

A substrate 18*a* is received on the drum 12*a* and serves as a carrier for the final printed image. A print head 20*a* is located next to the drum 12*a* for directing radiation curable ink to the substrate 18*a*. Optionally, the print head 20*a* is identical to the print head 20 described above.

The apparatus 10*a* also includes a curing device 22*a*. The curing device comprises one or more sources of ultraviolet radiation (such as lamps) having a wavelength suitable for curing the selected ink. The curing device 22*a* extends in a direction that is generally parallel to the central reference axis 14*a*.

The curing device 22*a* also includes an elongated, movable mask 24*a* having one or more apertures 26*a*. The mask 24*a* is connected to a drive 28*a* which, in turn, is electrically coupled to a controller 30*a*. The drive 28*a* is operable to selectively move the mask 24*a* in either direction along a path that is preferably parallel to the central reference axis 14*a*.

The print head 20*a* and the lamps of the curing device 22*a* are also connected to the controller 30*a*. The controller 30*a* may be programmed to provide any one of a number of different time intervals between the time that each ink drop contacts the substrate 18*a* and the time that the radiation from the curing device 22*a* is received by the same ink drop. Preferably, that time interval is greater than the time needed for the drum 12*a* to rotate through an arc of at least 360 degrees, so that the ink drop has sufficient time to spread and level as may be necessary to provide good image quality.

As an example of use, the controller 30*a* maybe programmed to activate the print head 20*a* in such a manner that two nozzles, designated 32*a* in FIG. 3, simultaneously direct drops of ink toward the substrate 18*a*. The controller 30*a* also activates the drive 28*a* in order to move the mask 24*a*. The mask 24*a* is moved in such a fashion that the apertures 26*a* are positioned directly between the UV radiation source and the ink drops at a time that is subsequent to the initial 360 degree rotation of the drum 12*a*, as determined by the time that the ink drops first contacted the substrate 18*a*. As a result, the ink drops do not begin to substantially cure until the drum 12*a* has rotated through an arc of at least 360 degrees.

Preferably, the nozzles of the print head 20*a* are actuated in staggered fashion, in concert with movement of the mask 24*a*. As such, the curing device 22*a* may cure ink drops that are received on a first section of the substrate while the print head 20*a* is directing ink drops toward a second section of the substrate. Such operation helps ensure that the ink drops do not prematurely cure, and yet facilitates completion of the printing in a relatively short amount of time.

Figure 5:
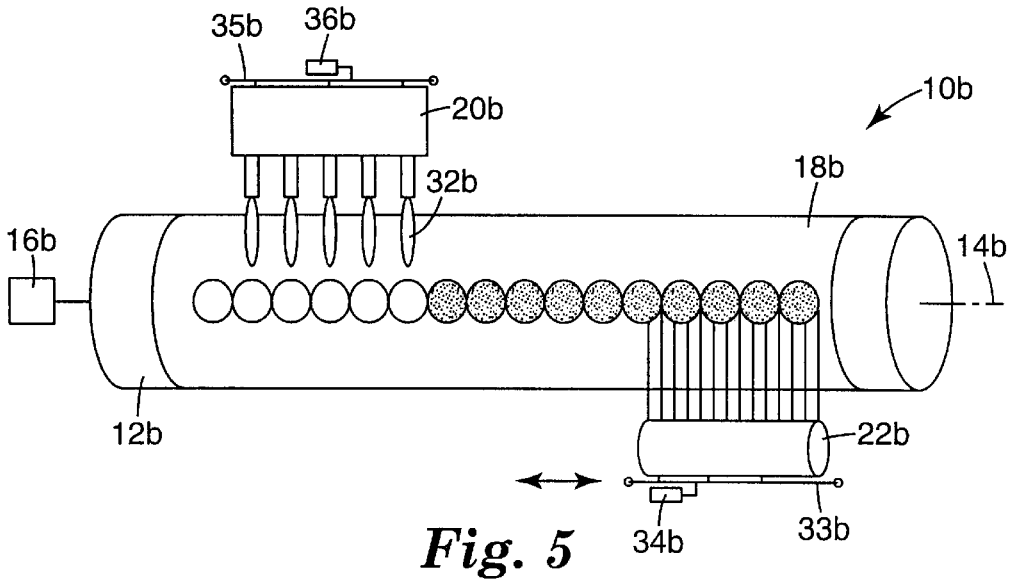
FIG. 5 is a schematic plan view of an inkjet printing apparatus according to yet another embodiment of the invention.

An inkjet printing apparatus 10*b* according to another embodiment of the invention is illustrated in FIG. 5. The apparatus 10*b* includes a drum 12*b* that is rotatable about a central reference axis 14*b*. A motor 16*b* is connected to the drum 12*b* for selective rotation of the latter.

A substrate 18*b* is received on the drum 12*b*. A print head 20*b* is operable to direct UV radiation curable ink toward the substrate 18*b* that is received on the drum 12*b*. The print head 20*b* includes a plurality of nozzles 32*b* that are electrically connected to a controller 30*b* for selective, timed operation.

A curing device 22*b* is mounted on a carriage 33*b* for movement along a path that is preferably parallel to the central reference axis 14*b*. The carriage 33*b* is linked to a drive 34*b* for movement in either direction along the path. The drive 34*b* is connected to the controller 30*b* for selective, timed movement of the carriage 33*b* and the curing device 22*b* in either direction along the path.

In this embodiment, the print head 20*b* is also mounted on a carriage 35*b*. The carriage 35*b* is connected to a drive 36*b* that is electrically connected to the controller 30*b*. The drive 36*b* is operable to move the carriage 35*b* and the print head 20*b* in either direction along a path that is also preferably parallel to the central reference axis 14*b*.

In use of the apparatus 10*b*, the controller 30*b* preferably controls operation of the drives 34*b*, 36*b* in such a fashion that the radiation from the curing device 22*b* does not reach ink on the substrate 18*b* until that ink has revolved with the substrate 18*b* along an arc that is at least 360 degrees. For example, the drive 36*b* may advance the print head 20*b* to the left in FIG. 5, while the drive 34*b* advances the curing device 22*b* in the same direction in synchronous fashion but in a manner such that the print head 20*b* is spaced from the curing device 22*b* in directions parallel to the axis 14*b*. Optionally, that spacing remains constant during operation of the apparatus 10*b*. With proper selection of the spacing and of the rotational speed of the drum 12*b*, the ink received on the substrate 18*b* does not receive radiation from the curing device 22*b* until that ink has moved with the substrate 18*b* and the drum 12*b* through an arc that is at least 360 degrees.

Optionally, the drives 34*b*, 36*b* may be mechanically linked together and operated by a single motor. For example, the drives 34*b*, 36*b* may be mechanically coupled together for simultaneous movement by a chain and a set of sprockets. A pneumatic or hydraulic coupling may also be used. In such a system, it is important to ensure that the curing device 22*b* is movable along a path that corresponds to the path of movement of the print head 20*b* so that all of the ink deposited on the substrate 18*b* is ultimately cured.

A number of other options are also possible. For example, the apparatus 10*b* illustrated in FIG. 5 may also include a movable mask similar to the mask 24*a*. As another option, the controller 30*b* may be programmed to operate the print head 20*b* such that the print head 20*b* makes more than one pass across the length of the drum 12*b* before the drum 12*b* incrementally rotates.

Additionally, the apparatus 10, 10*a*, 10*b* may include a second curing device (not shown) that is spaced from the curing devices mentioned above. The second curing device may optionally be located a distance away from the drum, such as in an area where the substrate is held in a flat orientation. As an example, once the printing has been completed, the substrate may be directed from the drum to a flat bed which lies beneath the second curing device. In this manner, the drum can receive a second substrate and printing on the second substrate may begin while the ink on the first substrate is cured to completion on the flat bed.

EXAMPLE

The printer in this example has a roll-to-sheet drum configuration. The drum car accommodate a sheet 165 cm by 380 cm (65 in by 150 in) with a maximum image size of 162 cm by 366 cm (63.8 in by 144 in). The clamping mechanism for the sheet is approximately 15 cm (6 inches) the drum diameter is (380+15)π=126 cm (50 in). The print resolution is 336 dpi.

The printer has 25 print heads per color. Each print head has 48 nozzles spaced at a native resolution of 18.7 dpi (dots per linear inch). At this native resolution, printing at 336 dpi requires a minimum of 336/18.7=18 revolutions to complete the print. If multi-pass printing is used, for example, to minimize banding defects, then the number of revolutions required is increased by a factor equal to the multi-pass. For a multi-pass printing of 3, the number of revolutions is 18 times 3, or 54. The number of revolutions between adjacent pixels in the circumferential direction is 18, 18 and 36 for this printer. The number of revolutions between adjacent pixels in the axial direction depends upon how much the print head carriage shifts in the axial direction per revolution. The total print head carriage shift after completing the print (54 revolutions in this case) is the bridge shift.

The print heads can deliver drops at a variety of rates ranging from 3 to 11 kHz and a typical firing frequency is 9 kHz. At a frequency of 9 kHz, a print resolution of 336 dpi and a multi-pass printing mode of 3, the speed of the outer surface of the drum is 9000/336*3=80.4 inches/second=402 feet/minute−204 cm/second and the rotation rate is 204/(380+15)=0.52 revolutions/second. One revolution of the drum takes 1/0.52=1.9 seconds and the printing time (not including loading and unloading) is 54/0.52=105 seconds.

The print heads produce drops with a volume of 70 pL (as found, for example, with the "Gen2" brand print heads from Hitachi or the 200 dpi print heads from XAAR). At a resolution of 336 dpi and a drop volume of 70 pL, the minimum theoretical required dot gain to achieve complete solid fill is 2.1 (in this example, dot gain is defined as the ratio of the final drop diameter on the media (D) to the drop diameter before impacting the media (d); 70 pL drops have d=51 microns, and D=107 microns, giving minimum required dot gain of 107/51=2.1). In practice, the required minimum dot gain is taken as 1.25 times the theoretical dot gain in order to allow for imperfections in print head performance such as cross-talk, non-uniform ink drop size, and misdirected ink drops. So, in order to achieve optimum image quality, the practical minimum required dot gain for this system is 1.25 times 2.1, or 2.625. Therefore, the final dot on the substrate should have minimum diameter D=134 microns.

Single drops of UV curable inkjet ink are printed onto the 180-10 cast vinyl film such as "ControlTac" brand 180 series vinyl film from 3M Company of St. Paul, Minn. The increase in dot diameter is determined as a function of time. The table below shows the results.

| Time seconds | dot diameter microns |
|---|---|
| 0 | 72 |
| 0.5 | 115 |
| 8 | 134 |
| 16 | 146 |
| 24 | 141 |
| 32 | 142 |
| 40 | 144 |
| 48 | 145 |
| 56 | 149 |
| 64 | 148 |
| 72 | 151 |
| 80 | 149 |
| 88 | 148 |
| 96 | 154 |
| 104 | 151 |
| 112 | 152 |
| 120 | 151 |

Consequently, in order to achieve the minimum required dot diameter of 134 microns, one should wait about 8 seconds before curing the ink.

Optionally, it is possible to heat the rotating drum during printing in order to raise the substrate temperature. By heating the substrate the drop spread and leveling on the substrate can be controlled and accelerated (so that the minimum required time in the above example is less than 8 seconds). Furthermore, heating the substrate can help to remove excess moisture in the substrate in order to minimize curl of the final printed product.

In addition to the embodiments described above, other variations are also possible. Accordingly, the invention should not be deemed limited to the specific examples described above, but only by a fair scope of the claims that follow along with their equivalents.

What is claimed is:

1. Inkjet printing apparatus comprising:

a drum for supporting a substrate, the drum having a central reference axis;

a motor for moving the drum with the substrate in an arc about the central axis;

a print head for directing radiation curable ink toward the substrate;

a curing device for directing radiation toward the ink received on the substrate, wherein the curing device is selectively operable to direct the radiation toward a certain portion of the ink received on the substrate only after that certain portion has moved with the substrate along an arc about the central axis that is at least 360 degrees.

2. Inkjet printing apparatus according to claim 1 wherein the apparatus also includes a control device that is operable to vary the time interval between the time that the certain portion of the ink is received on the substrate and the time that the radiation from the curing device is received by the certain portion of the ink on the substrate.

3. Inkjet printing apparatus according to claim 1 wherein the curing device and the print head are selectively operable simultaneously such that radiation is directed toward the certain portion of the ink located over a first section of the substrate while the print head is directing ink toward a second section of the substrate.

4. Inkjet printing apparatus according to claim 1 wherein the curing device includes a shutter that is movable between an open position and a closed position in order to control radiation directed toward the substrate.

5. Inkjet printing apparatus according to claim 1 wherein the curing device includes an instant-on, instant-off lamp.

6. Inkjet printing apparatus according to claim 1 wherein the print head is movable in a direction generally parallel to the central axis, and wherein the curing device emits a source of radiation that is segmented and the segments move simultaneously with the print head.

7. Inkjet printing apparatus according to claim 6 wherein the segments are provided by a mask having an opening that is spaced from the print head for directing radiation toward the substrate, and wherein simultaneous movement of the print head and the mask move the print head and the opening of the mask along paths that are similar but offset from one another.

8. Inkjet printing apparatus according to claim 1 wherein the curing device is positioned to cure the ink on the substrate when the substrate is supported on the drum.

9. Inkjet printing apparatus according to claim 8 wherein the radiation is directed toward the drum.

10. Inkjet printing apparatus according to claim 8 wherein the drum rotates at least two revolutions between the time that the ink is received on the substrate and the time that the same ink receives radiation from the curing device.

11. Inkjet printing apparatus according to claim 1 wherein the apparatus includes a curing bed spaced from the drum, and wherein the curing device is positioned to cure the ink on the substrate when the substrate is received on the bed.

12. Inkjet printing apparatus according to claim 1 wherein the curing device is operable to partially cure the certain portion of the ink before such certain portion has moved with the substrate about a 360 degree arc.

13. Inkjet printing apparatus according to claim 1 wherein the curing device is operable to partially cure the certain portion of the ink after the certain portion has moved with the substrate about an arc that is at least 360 degrees, and wherein the apparatus includes a second curing device spaced from the first curing device for substantially completing the cure in a location spaced from the drum.

14. Inkjet printing apparatus according to claim 1 and including a heater for heating the substrate.

15. Inkjet printing apparatus according to clam 14 wherein the heater is connected to the drum.

16. Inkjet printing apparatus according to claim 14 wherein the heater is located inside of the drum.

17. Inkjet printing apparatus according to claim 1 wherein the control device is operable to activate the print head for directing ink to a first section of the substrate while the curing device cures the ink received on a second section of the substrate.

18. Inkjet printing apparatus according to claim 1 wherein the curing device includes a mask with at least one opening that is movable along a path generally parallel to the central axis.

19. Inkjet printing apparatus according to claim 18 wherein the print head is movable along a path generally parallel to the path of movement of the at least one opening of the mask.

20. Inkjet printing apparatus according to claim 19 wherein the print head moves at approximately the same velocity as the velocity of the at least one opening.

21. A method of inkjet printing comprising:

supporting a substrate on a drum;

moving the drum in an arc about its central axis;

directing radiation curable ink onto the substrate;

determining a desired time interval between the time that the ink is received on the substrate and the time that the ink is cured; and directing radiation toward the ink on the substrate, wherein the act of directing the radiation toward the substrate includes the act of selectively adjusting the time interval between the time that the ink is received on the substrate and the time that the radiation is received by the ink on the substrate such that at least a portion of the ink does not receive radiation until the substrate with the ink portion has moved with the drum along an arc that is at least 360 degrees.

22. A method of inkjet printing according to claim 21 and including the act of directing radiation toward a certain portion of ink located over a first section of the substrate while ink is directed toward a second section of the substrate.

23. A method of inkjet printing according to claim 21 wherein the act of adjusting the time interval includes the acts of opening and closing a shutter.

24. A method of inkjet printing according to claim 21 wherein the act of adjusting the time interval is carried out using an instant-on, instant-off lamp.

25. A method of inkjet printing according to claim 21 wherein the act of adjusting the time interval includes the act of moving an opening of a mask between a source of radiation and the substrate.

26. A method of inkjet printing according to claim 25 wherein the act of directing radiation curable ink onto the substrate is carried out using a movable print head, and wherein the print head and the opening of the mask move along paths that are generally parallel to one another.

27. A method of inkjet printing according to claim 21 wherein the act of directing radiation toward the ink on the substrate is carried out while the substrate is supported on the drum.

28. A method of inkjet printing according to claim 21 wherein the act of directing radiation toward the ink on the substrate is carried out after the substrate has been at least partially removed from the drum.

29. A method of inkjet printing according to claim 21 wherein the act of directing radiation toward the ink on the substrate includes the act of directing a portion of the radiation toward the ink on the substrate before such time as such ink has moved with the drum in an arc that is at least 360 degrees.

* * * * *